US005389013A

United States Patent [19]

Kourimsky

[11] Patent Number: 5,389,013

[45] Date of Patent: Feb. 14, 1995

[54] ELECTRICAL TERMINAL WITH MEANS TO AVOID LOCKING LANCE DAMAGE AND ENTANGLEMENT

[75] Inventor: Friedrich J. A. Kourimsky, Bensheim, Germany

[73] Assignee: The Whitaker Corporation, Wilmington, Del.

[21] Appl. No.: 179,290

[22] Filed: Jan. 10, 1994

[30] Foreign Application Priority Data

Jan. 27, 1993 [GB] United Kingdom ..... 9301541

[51] Int. Cl.[6] ..... H01R 13/432

[52] U.S. Cl. ..... 439/746; 439/744

[58] Field of Search ..... 439/744–750

[56] References Cited

U.S. PATENT DOCUMENTS 3,808,590 4/1974 Hemmer et al. ..... 439/744 X

FOREIGN PATENT DOCUMENTS

3629740AI 9/1986 Germany .

*Primary Examiner*—Eugene F. Desmond

*Attorney, Agent, or Firm*—Eric J. Groen; Adrian J. LaRue

[57] ABSTRACT

An electrical terminal is shown having a contacting section, a locking section, a slidable sleeve and a wire connecting section. The locking section is defined as a cylindrical base out of which are stamped locking lances from the cavity area. The terminal is inserted into the cavity of an associated electrical connector housing. Prior to insertion, a slidable sleeve encompasses the locking lances thereby resiliently biasing them into the cavities, the locking lances therefore flush with the base of the locking section.

7 Claims, 4 Drawing Sheets

ELECTRICAL TERMINAL WITH MEANS TO AVOID LOCKING LANCE DAMAGE AND ENTANGLEMENT

BACKGROUND OF THE INVENTION

1. Field of the Invention

The invention relates to an electrical terminal with means to protect the locking lances from damage and entanglement during handling and transport.

2. Description of the Prior Art

Among the common types of electrical terminals are those stamped and formed from sheet metal, comprising a contact section, a locking section and a conductor attachment section. The locking section, usually of larger periphery than the contact section, has locking lances stamped out of the base of the locking section and extending obliquely outwards with respect to the longitudinal axis of the terminal. As the terminals are pushed into cavities in an associated housing the locking lances are biased resiliently towards the base of the locking section as they pass under a shoulder in the housing cavity, the locking lances springing outwardly once past the shoulder hence abutting against the shoulder and preventing a rearward extraction of the terminal from the housing. The forward retention means usually consisting of a protrusion attached to and extending from the base of the rear end of the Locking section outwards, the front face of the protrusion abutting against the rear face of the housing cavity shoulder. An electrical connector housing usually has a plurality of terminal receiving cavities into which the terminals are inserted. Prior to insertion each one of the terminals is crimped to a conducting cable and the terminals corresponding to one connector housing are then harnessed together.

One of the problems associated to the present terminals is that, prior to insertion in the connector housing, the exposed locking lances and electric cables may get entangled, which may result in damageably bending the lances or cutting of the electric cables due to the locking lances sharp edges emanating from their manufacturing process which involves shearing them out of thin sheet metal. Damage of the locking lances may prevent their insertion into the cavities or impair their retention qualities and damage to the electrical cable or its insulation may impair the correct electrical functioning of the electrical connector. Another problem rising from the barbed aspect of the locking lance prior to insertion in the electrical connector housing is that they get caught with other locking lances, terminals or cables, this being time consuming, difficult and therefore costly to disentangle.

SUMMARY OF THE INVENTION

With respect to the above mentioned problems, the object of this invention is therefore to provide a means by which the locking lances cannot get caught with other objects, especially referring to other terminals and harnesses.

The above mentioned object is achieved by providing an electrical terminal that comprises a sleeve slidable over the base of the locking section of the terminal, the slidable sleeve resiliently biasing the locking lances inwardly towards the base of the locking section and therefore retracting the lances to a position where they cannot get caught with other objects, the sleeve slidable off the locking lances during insertion of the terminal into the terminal receiving cavity of the associated housing so as to allow the locking lances to spring outwardly and lock the terminal in the housing.

DETAILED DESCRIPTION OF THE PREFERRED EMBODIMENT

Figure 1:
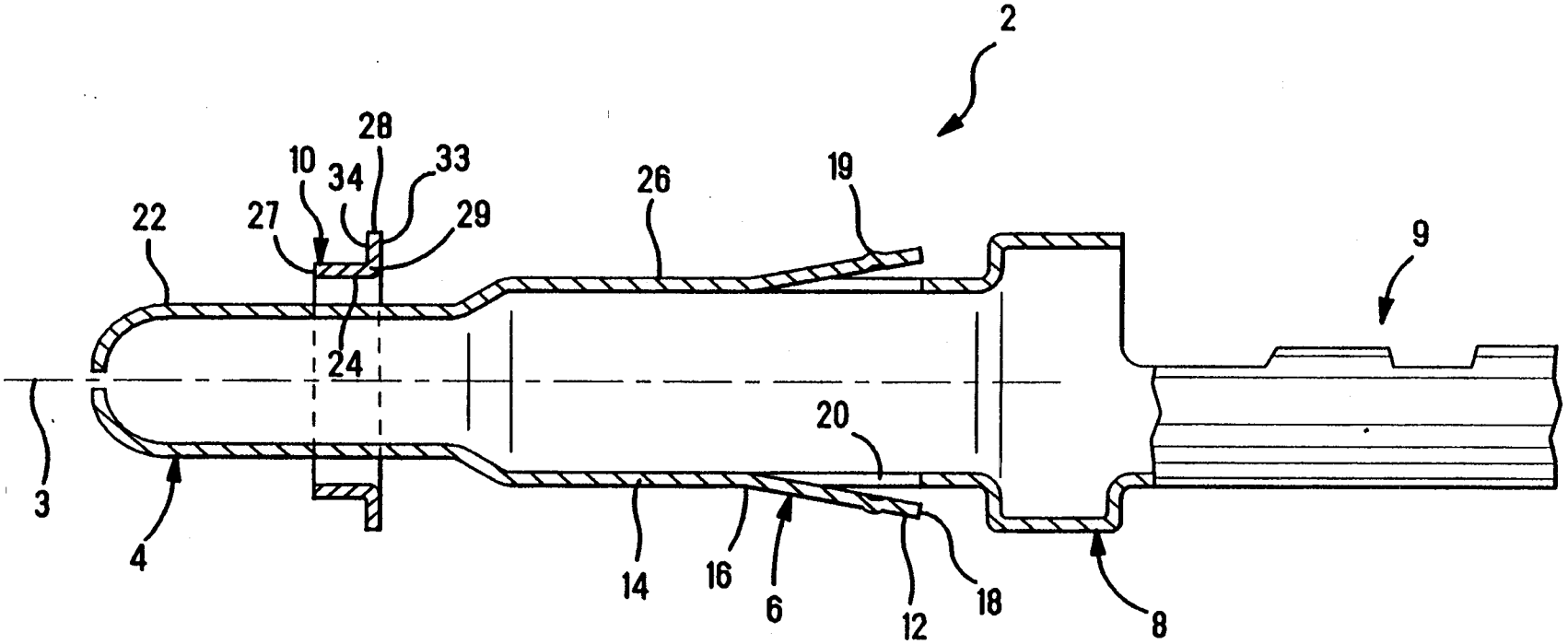
FIG. 1 is a side view of the electrical terminal in accordance with the invention, whereby the slidable sleeve is about to be engaged over the locking section.

With reference to FIG. 1, an electrical terminal 2 is generally shown extending along a longitudinal axis 3, comprising a contacting section 4, a locking section 6, a retaining section 8, a wire connecting section 9, (only partially shown), and a slidable sleeve 10. Still with respect to FIG. 1, locking lances 12 attached to a base 14 of the locking section 6 generally stamped and formed therefrom, are shown in their free standing position whereby the locking lances 12 depart from attached ends 16 obliquely outwardly with respect to the longitudinal axis 3 towards free rear ends 18. The locking lances 12 are formed in such a manner that when resiliently biased towards the base 14 until they lie fully within a cavity area 20 out of which they have been stamped thereby lying flush to the base 14 of the locking section 6, there is no plastic deformation. In other words, once released the locking lances will spring outwardly to their original free standing position.

Figure 2:
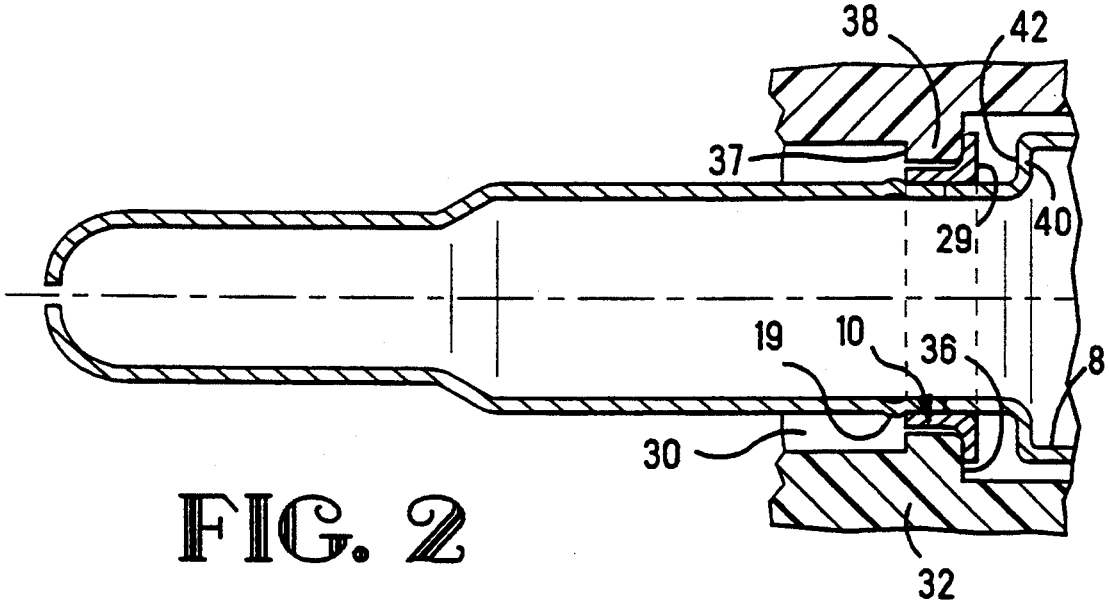
FIG. 2 is a side view of the preferred embodiment whereby the slidable sleeve is engaged over the locking lances, defining the state of the terminal prior to full insertion into the terminal receiving cavity of the housing.
Figure 5:
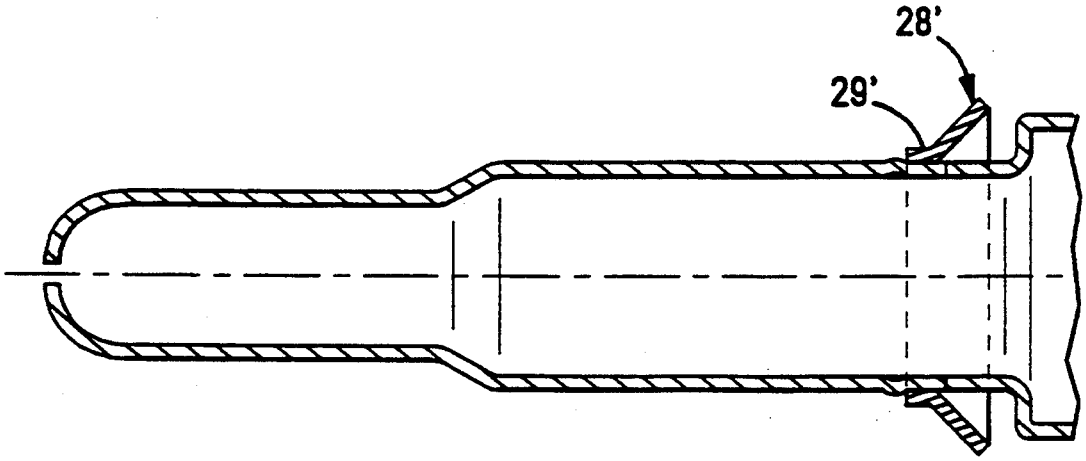
FIG. 5 is a side view of an alternative embodiment, the slidable sleeve engaged over the locking lances.

The cross-sectional shape of a base 22 of the contacting section 4 of an electrical terminal 2 with respect to the longitudinal axis 3, may be of a cylindrical or polygonal shape although a cylindrical shape has been chosen to illustrate the pin terminals of FIGS. 1, 2, 3, 5 and 6. Likewise, the cross-sectional shape of the base 14 with respect to the longitudinal axis 3 may also be of a cylindrical or polygonal shape. The base 14 of the locking section 6 is at a greater distance from the longitudinal axis 3 than the base 22 of the contacting section 4 as illustrated in FIGS. 1, 2 and 5.

A ring shaped sleeve 10 having an inner surface 24 is fed over the contacting section 4 as shown in FIG. 1 and then slid over the locking section 6 to a position encompassing the locking lances as illustrated in FIG. 2. A dimple 19 formed out of the locking lance prevents the sleeve 10 from falling off the terminal 2.

In the preferred embodiment, the inner surface 24 of the slidable sleeve 10 substantially matches an outer surface 26 of the base 14, the inner surface 24 however finding itself at a slightly larger inner diameter than the diameter of the surface 26 in order to allow the sleeve 10 to slide over the base 14. The sleeve 10 is then slid over the lances 12, to bias them resiliently into the cavity area 20 out of which they were stamped so that they lie flush to the base 14 as shown in FIG. 2. In this position the free rear ends 18 of the locking lances 12 no longer protrude outwards of the base 14 and in accordance with the invention can therefore not get caught with other objects especially referring to other terminals and their harnesses.

Figure 3:
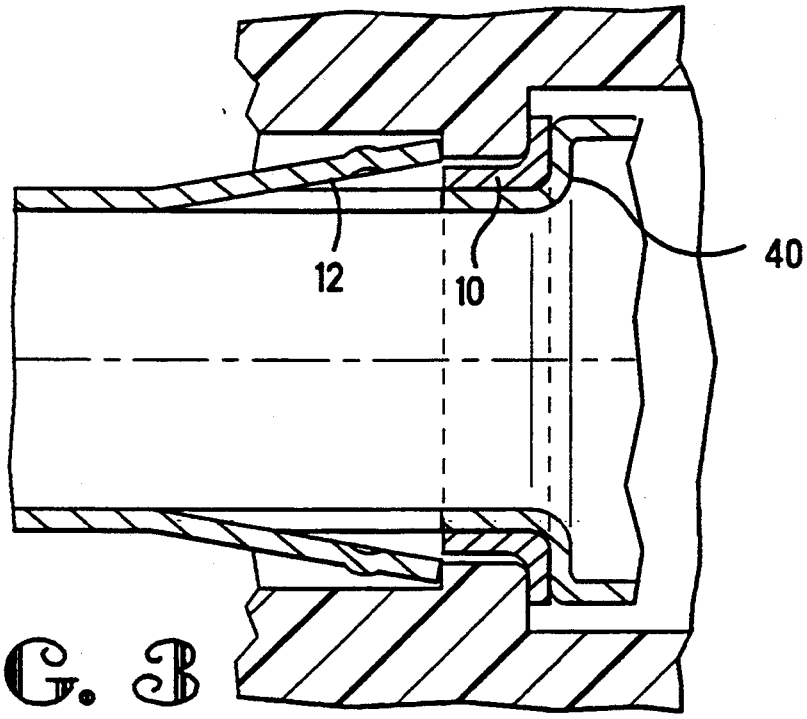
FIG. 3 is a side view of the preferred embodiment showing the terminal in its fully inserted and locked position within the housing.

In the preferred embodiment the slidable sleeve 10 has a flange 28 attached to a rear end 29 and extending perpendicularly outwards with respect to the longitudinal axis 3 thereof. As the electrical terminal 2 is inserted into a terminal receiving cavity 30 of an electrical connector housing 32, a front face 34 of the flange 28 shall abut against a rear face 36 of a shoulder 38 as shown in FIG. 2. As the terminal 2 is inserted further into the terminal receiving cavity 30 the rear end 18 of the locking lance 12 will slide past a front end 27 of the sleeve 10 hence allowing the locking lance 12 to spring outwards and abut rearwardly on a front face 37 of the shoulder 38 hence retaining the terminal 2 within the terminal receiving cavity 30 as shown in FIG. 3. A protrusion 40 attached to and extending outwardly from the rear end of the base 14, having a front face 42 that abuts against a rear face 33 of the flange 28 which abuts the shoulder 38, hence retains forward movement of the terminal 2 with respect to the electrical connector housing 32. The latter happening only once the rear end 18 of the locking lance 12 has passed the front face 37 of the shoulder 38 thereby assuring retention of the terminal 2 from both forwards and rearwards movement with respect to the electrical connector housing 32 as shown in Figure 3.

Figure 6:
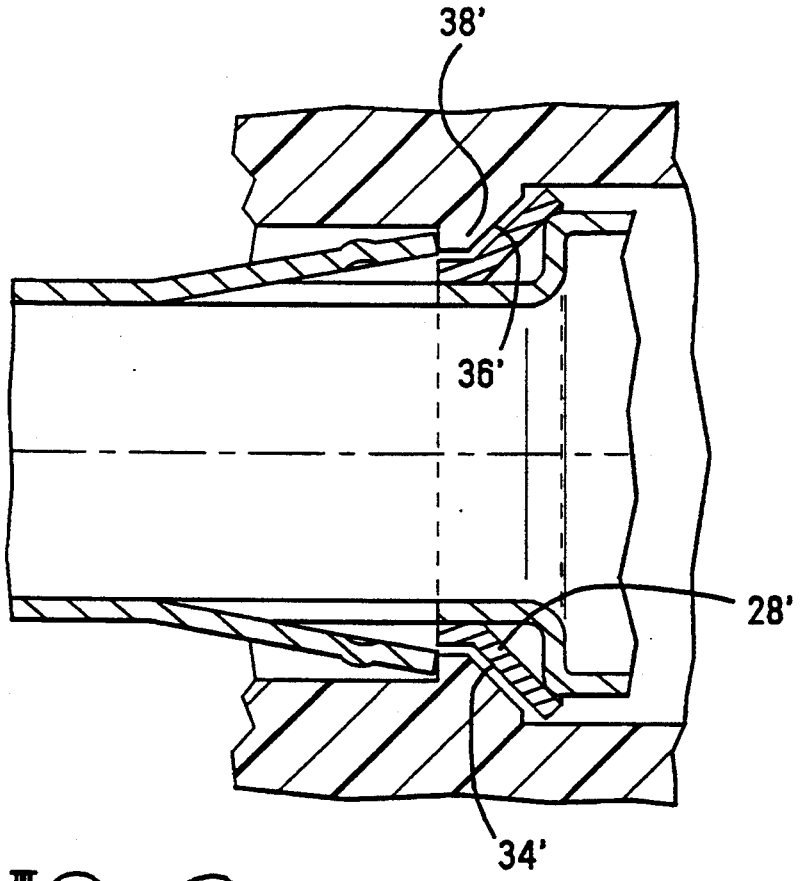
FIG. 6 is the same embodiment as FIG. 5 but showing the terminal in its fully inserted and locked position within an electrical connector housing.

FIGS. 5 and 6 show an alternative embodiment of the invention corresponding to FIGS. 2 and 3 respectively whereby the flange 28′ extends from the rear end of the sleeve 29′ in an oblique manner, the rear face 36′ of the shoulder 38′ having likewise an oblique face to mate with the front face 34′ of the flange 28′ as illustrated by FIG. 6.

Figure 4:
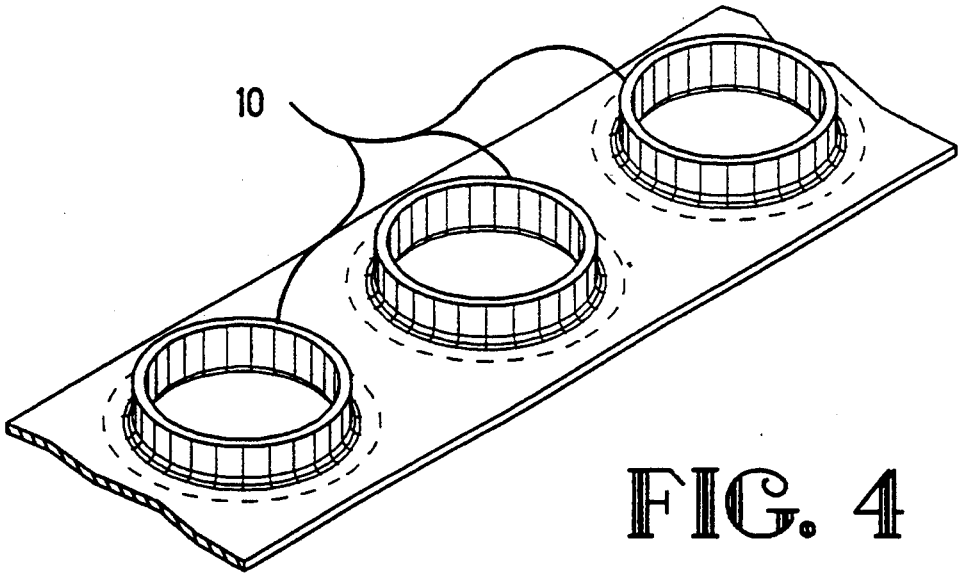
FIG. 4 is an isometric view describing a method of producing the slidable sleeves.

FIG. 4 illustrates a low cost method for producing the sleeve 10 by forming and stamping them out of a strip of sheet metal.

Many different shapes of the flange 28 of the slidable sleeve 10 and varying lengths of the sliding surface 24 of the slidable sleeve 10 can be imagined without departing from the spirit of this invention.

This invention is also applicable to female terminals and separate sleeves comprising the locking lances which are attached to terminals, examples of which are given in patent DE 36 29 740 A1.

I claim:

1. An electrical terminal comprising a locking section, having a base, and at least one resilient locking lance attached to the base, and a forward retaining protrusion, the lance and protrusion serving to retain the electrical terminal against a shoulder within an associated cavity of a housing, the terminal wherein the locking section comprises a sleeve slidable over the locking lance so as to resiliently bias the lance inwardly towards the base, the sleeve being slidable off the locking lance during entry of the terminal into the cavity of the housing so as to allow the locking lance to spring outwardly and lock the terminal in the housing.

2. The electrical terminal of claim 1 wherein the sleeve has a flange extending outwardly with respect to a longitudinal axis, the flange abutting against a rear face of the shoulder during entry of the terminal into the housing, the sleeve hence retained by the flange against the shoulder from forward movement during forward movement of the terminal into the locked position within the housing, whereby in the locked position the locking lance abuts rearwardly against a front face of the housing cavity shoulder.

3. The terminal of claim 2 wherein when the terminal is locked within the housing a front face of the protrusion abuts a rear face of the flange and a front face of the flange abuts the rear face of the housing cavity shoulder.

4. The terminal of claim 2 or 3 wherein the flange is attached to a rear end of the sleeve and projects outwardly perpendicularly therefrom.

5. The terminal of claim 2 or 3 wherein the flange is attached to a rear end of the sleeve and projects outwardly obliquely therefrom.

6. The terminal of claim 1, 2, or 3 wherein the sleeve comprises an inner surface lying substantially against an outer surface of the base but leaving a small space therebetween to allow sliding of the sleeve over the base.

7. The terminal of claim 1,2, or 3 wherein the locking lance has a dimple.

* * * * *